US009885969B2

(12) United States Patent
Tanabe et al.

(10) Patent No.: US 9,885,969 B2
(45) Date of Patent: Feb. 6, 2018

(54) CARRIER FOR TWO-COMPONENT DEVELOPER, TWO-COMPONENT DEVELOPER, AND METHOD OF PREPARING CARRIER FOR TWO-COMPONENT DEVELOPER

(71) Applicant: FUJI XEROX CO., LTD., Tokyo (JP)

(72) Inventors: Takeshi Tanabe, Kanagawa (JP); Toshiaki Hasegawa, Kanagawa (JP); Masaaki Usami, Kanagawa (JP); Yasunobu Kashima, Kanagawa (JP); Takeshi Iwanaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/227,662

(22) Filed: Aug. 3, 2016

(65) Prior Publication Data

US 2017/0277054 A1 Sep. 28, 2017

(30) Foreign Application Priority Data

Mar. 28, 2016 (JP) ..... 2016-064305

(51) Int. Cl.

| | |
|---|---|
| ***G03G 9/00*** | (2006.01) |
| ***G03G 9/113*** | (2006.01) |
| ***G03G 9/08*** | (2006.01) |

(52) U.S. Cl.

CPC ..... *G03G 9/1133* (2013.01); *G03G 9/0819* (2013.01); *G03G 9/0821* (2013.01); *G03G 9/1131* (2013.01); *G03G 9/1132* (2013.01); *G03G 9/1135* (2013.01)

(58) Field of Classification Search

CPC ... G03G 9/1132; G03G 9/1135; G03G 9/1131
See application file for complete search history.

(56) References Cited

U.S. PATENT DOCUMENTS 6,051,353 A * 4/2000 Hoffend ..... G03G 9/1075 430/111.1
2011/0024669 A1* 2/2011 Naka ..... G03G 9/107 252/62.54

FOREIGN PATENT DOCUMENTS

| | | | |
|---|---|---|---|
| JP | H02-87169 | A | 3/1990 |
| JP | 3794506 | B2 | 7/2006 |
| JP | 2011-008160 | | 1/2011 |
| JP | 5495633 | B2 | 5/2014 |
| JP | 2014-160182 | A | 9/2014 |

* cited by examiner

*Primary Examiner* — Mark A Chapman
(74) *Attorney, Agent, or Firm* — Oliff PLC

(57) ABSTRACT

A carrier for two-component developer includes a magnetic particle and a resin coating layer that covers the magnetic particle and contains a resin, wherein a weight average molecular weight of the resin contained in the resin coating layer is from 1,800,000 to 5,000,000.

10 Claims, 1 Drawing Sheet

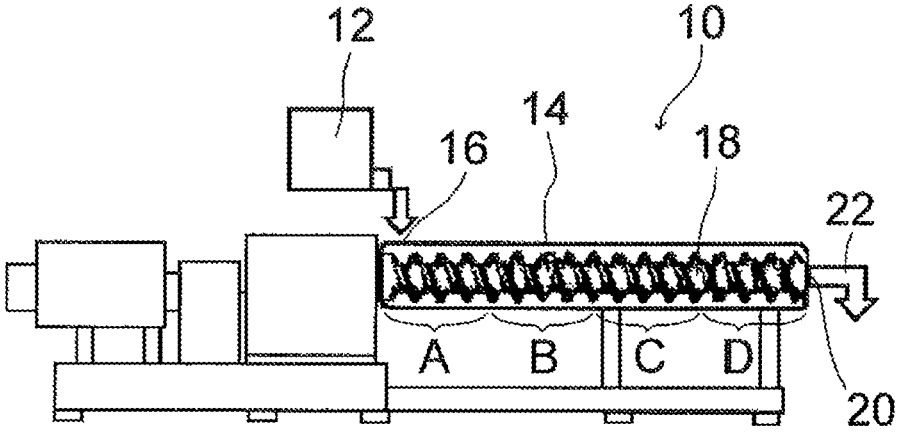
12
10
14
16
18
22
A
B
C
D
20

CARRIER FOR TWO-COMPONENT DEVELOPER, TWO-COMPONENT DEVELOPER, AND METHOD OF PREPARING CARRIER FOR TWO-COMPONENT DEVELOPER

CROSS-REFERENCE TO RELATED APPLICATIONS

This application is based on and claims priority under 35 USC 119 from Japanese Patent Application No. 2016-064305 filed Mar. 28, 2016.

BACKGROUND

1. Technical Field

The present invention relates to a carrier for two-component developer, two-component developer, and method of preparing a carrier for two-component developer.

2. Related Art

Currently, a method of visualizing image information through an electrostatic latent image such as an electrophotographic method is widely utilized in various fields. In the electrophotographic method, the electrostatic latent image on the surface of the photorecepter (image holding member) which passes through the charging step, the exposure step, and the like is visualized by developing the electrostatic latent image with developer containing a toner, and passes through the transferring step, the fixing step, and the like.

The developer may be two-component developer composed of a toner and a carrier, or single-component developer such as a magnetic toner in which the toner is used alone. Among them, the two-component developer is currently widely used since the carrier shares the functions such as agitation, transport, and charging of the developer, and is functionally separated from the developer, and thus the two-component developer has good controllability.

SUMMARY

According to an aspect of the invention, there is provided a carrier for two-component developer, including:

a magnetic particle; and a resin coating layer that covers the magnetic particle and contains a resin, wherein a weight average molecular weight of the resin contained in the resin coating layer is from 1,800,000 to 5,000,000.

BRIEF DESCRIPTION OF THE DRAWINGS

Exemplary embodiments of the present invention will be described in detail based on the following FIGURES, wherein:

The FIGURE is a schematic cross-sectional view showing an example of a continuous heat treatment apparatus suitably used in the preparation of a carrier for two-component developer according to the exemplary embodiment.

DETAILED DESCRIPTION

Hereinafter, exemplary embodiments of the invention will be described in detail.

In the exemplary embodiment, the description of "A to B" represents not only a range between A and B but also a range including A and B being both ends. For example, if "A to B" is a numerical range, the value represents "A or more and B or less" or "B or more and A or less" depending on the magnitude of the numeric value.

Furthermore, in the following description, combinations of two or more preferable exemplary embodiments are more preferable exemplary embodiments.

Carrier for Two-Component Developer

The carrier for two-component developer (hereinafter, simply referred to as "carrier") of the exemplary embodiment includes magnetic particles and a resin coating layer that covers the magnetic particles and contains a resin, and the weight average molecular weight of the resin included in the resin coating layer is from 1,800,000 to 5,000,000.

The present inventors have investigated intensively and found that a preparing method of a carrier for two-component developer including:

an attaching step of mixing resin particles having a weight average molecular weight of from 1,800,000 to 5,000,000, which correspond to the resin contained in the resin coating layer of the carrier for two-component developer, with magnetic particles so that the resin particles attach onto the surface of the magnetic particles; and a heating step for forming a resin coating layer, which includes charging the magnetic particles, onto which the resin particles are attached, in a continuous heat treatment apparatus from a raw material supply port thereof, wherein the continuous heat treatment apparatus includes a rotator in which a rotating shaft is provided in the same direction as the traveling direction from the raw material supply port toward an outlet in a casing having the raw material supply port and the outlet and is capable of controlling the temperature of each portion of the casing, and heating the magnetic particles onto which the resin particles are attached to melt the resin particles while passing the magnetic particles between the casing and the rotator, wherein, in the heating the magnetic particles, the following Expression 1 is satisfied.

Glass transition temperature of resin particles ($Tg$)+ 50° C.<Temperature of heat-melted product (° C.)≤Thermal decomposition starting temperature of resin particles ($TGA$) Expression 1

The present inventors also have found that the initial deletion abnormality preventing properties is excellent immediately after the developer is charged according to the preparing method of the carrier for two-component developer of the exemplary embodiment, thus completing the exemplary embodiment.

The detailed mechanism of action of the method is unknown but estimated as follows.

By using resins in which the weight average molecular weight is from 1,800,000 to 5,000,000 in the resin coating layer of the carrier for two-component developer, the uniformity of layer thickness and composition of the resin coating layer are improved, and the coverage and the adhesion to the magnetic particles are also improved. In addition, since the strength of the resin coating layer is excellent, the formation of scum during the preparation of the resin coating layer or cracking and chipping of the resin coating layer are prevented, and thus, it is estimated that the initial deletion abnormality preventing properties is excellent immediately after the developer is charged.

Magnetic Particles

The carrier for two-component developer of the exemplary embodiment includes magnetic particles and a resin coating layer covering the magnetic particles.

As the magnetic particles, known materials may be used. For example, magnetic metals such as iron, nickel, and cobalt, an alloy of these magnetic metals and manganese, chromium, rare earth metals, and the like, magnetic oxides such as iron oxide, ferrite, and magnetite, and resin dispersion type core material in which the conductive materials are dispersed in a matrix resin are exemplified.

As the resin used in the resin dispersion type core material, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, a styrene-acrylic acid copolymer, straight silicone resin configured to include an organosiloxane bond or modified product thereof, fluorine resin, polyester, polycarbonate, phenol resin, epoxy resin, and the like may be exemplified, but the invention is not limited thereto.

Among them, the magnetic particles are preferably magnetic oxide particles and more preferably ferrite particles.

The volume average particle diameter of the magnetic particles is preferably from 10 μm to 100 μm and more preferably from 20 μm to 50 μm. If the volume average particle diameter of the magnetic particles is 10 μm or more, then the adhesion between the toner and the carrier is moderate and the developing amount of the toner may be sufficiently obtained. On the other hand, if the diameter is 100 μm or less, then the magnetic brush does not become rough and thus an image with excellent reproducibility of fine lines is formed.

The volume average particle diameter d of the magnetic particles may be measured using a laser diffraction/scattering particle diameter distribution measurement device (LS Particle Size Analyzer: LS13 320, Beckman-Coulter Inc.). The particle diameter of the cumulative 50% is set to as a volume average particle diameter d by subtracting the volume cumulative distribution on the smaller particle diameter side from the obtained particle diameter distribution in the divided particle size ranges (channels).

As for the magnetic force of the magnetic particles, the saturation magnetization at 1,000 oersteds is preferably from 50 emu/g to 100 emu/g and more preferably from 60 emu/g to 100 emu/g. If the saturation magnetization is from 50 emu/g to 100 emu/g, the hardness of the magnetic brush is moderately kept, the fine-line reproducibility is improved, and the development of the carrier together with the toner on the photoreceptor may be also prevented.

An apparatus capable of measuring the magnetic properties is not particularly limited, but vibrating sample magnetic measurement device VSMP10-15 (manufactured by Toei Industry Co.) is preferably used.

For example, a measurement sample is packed in a cell of the inside diameter of 7 mm and the cell height of 5 mm and set in the device. The measurement is swept up to 1,000 Oe by adding the applied magnetic field. Then, the applied magnetic field is decreased to prepare a hysteresis curve on a recording sheet. The saturation magnetization, the residual magnetization, and the coercive force may be obtained from the data of the curve. In the exemplary embodiment, the saturation magnetization shows a magnetization measured in a magnetic field of 1,000 oersteds.

The volume electric resistance (volume resistivity) of the magnetic particles is preferably in a range of $10^3$ Ω·cm to $10^{9.5}$ Ω·cm, and more preferably in a range of $10^7$ Ω·cm to $10^9$ Ω·cm. If the volume electric resistance is $10^3$ Ω·cm or more, when the toner density in the developer is reduced by repeated copying, the charge injection to the carrier is not caused, and the carrier itself may be prevented from being developed. On the other hand, if the volume electric resistance is $10^{9.5}$ Ω·cm or less, then the outstanding edge effect and a false contour, and the like may be prevented. Thus, excellent image quality may be obtained.

In the exemplary embodiment, the volume electric resistance (Ω·cm) of the core material is measured as follows. The measurement environment is set to a temperature of 20° C. and a humidity of 50% RH.

The object to be measured is placed and flattened to have a thickness of 1 mm to 3 mm to form a layer on the surface of the circular holding device in which the electrode plate of 20 $cm^2$ is disposed. The layer is sandwiched by placing the electrode plate of 20 $cm^2$ similar to the above plate on the above later. In order to eliminate gaps between the objects to be measured, a load of 4 kg is applied on the electrode plate which is placed on the layer, and then the thickness (cm) of the layer is measured. Both electrodes on the upper and lower sides of the layer are connected to the electrometer and high-voltage power generator. A high voltage is applied to both electrodes such that an electric field becomes $10^{3.8}$ V/cm, and the volume electric resistance (Ω·cm) of the object to be measured is calculated by reading a current value (A) flowing at this time. Calculation Expression of the volume electric resistance (Ω·cm) of the object to be measured is shown in the following Expression.

$$R=E\times 20/(I-I_0)/L \qquad \text{Expression:}$$

In the above Expression, R represents the volume electric resistance (Ω·cm) of the object to be measured, E represents the applied voltage (V), I represents the current value (A), $I_0$ represents the current value (A) at an applied voltage of 0V, L represents the thickness (cm) of the layer, respectively. The coefficient of 20 represents the area ($cm^2$) of the electrode plate.

Resin Coating Layer

The carrier for two-component developer of the exemplary embodiment has a resin coating layer covering the magnetic particles, and the weight average molecular weight of the resin included in the resin coating layer is from 1,800,000 to 5,000,000. If the weight average molecular weight of the resin is from 1,800,000 to 5,000,000, the initial deletion abnormality preventing properties is excellent immediately after the developer is charged.

The weight average molecular weight of the resin contained in the resin coating layer is preferably from 2,000,000 to 4,500,000 and more preferably from 2,500,000 to 4,000,000. If the weight average molecular weight in the above range, the initial deletion abnormality preventing properties is excellent immediately after the developer is charged.

Further, the weight average molecular weight and the number average molecular weight in the exemplary embodiment are measured by gel permeation chromatography (GPC). In the adjustment of the toner solution for measurement, it is possible to dissolve the toner by heating or the like. The measurement of the molecular weight by GPC is carried out by using GPC (HLC-8220GPC) (manufactured by TOSOH CORPORATION) as a measurement device and Column (TSKgel SUPERHZM-H column) (manufactured by TOSOH CORPORATION) in tetrahydrofuran (THF) solvent at 40° C. The weight average molecular weight and number average molecular weight are calculated using a molecular weight calibration curve prepared by monodisperse polystyrene standard sample from the measurement results.

Examples of the resin used in the resin coating layer in which the weight average molecular weight thereof is from 1,800,000 to 5,000,000 include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, acrylic resin, straight silicone resin configured to include an organosiloxane bond or modified product thereof, fluorine resin, polyester, polycarbonate, phenol resin, epoxy resin, and the like, but the invention is not limited thereto.

Among them, as the resin used in the resin coating layer in which the weight average molecular weight thereof is from 1,800,000 to 5,000,000, homopolymers or copolymers of cycloalkyl methacrylate are preferable, homopolymers and copolymers of cyclohexyl methacrylate are more preferable from the viewpoint of controlling the charge amount, and homopolymers of cyclohexyl methacrylate is particularly preferable.

In addition, as the resin used in the resin coating layer in which the weight average molecular weight thereof is from 1,800,000 to 5,000,000, homopolymers and copolymers of a monomer represented by the following formula (1), that is, polymers having at least a monomer unit represented by the following formula (1A) are preferable.

Formula (1)

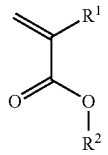

Formula (1A)

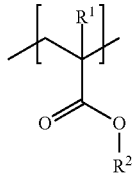

In the formula (1) and the formula (1A), $R^2$ represents a hydrogen atom or a methyl group, and $R^2$ represents a cycloalkyl group.

$R^2$ in the formula (1) and the formula (1A) is preferably a methyl group from the viewpoint of controlling the charge amount.

$R^2$ in the formula (1) and the formula (1A) is preferably a cycloalkyl group of a 5-membered to a 7-membered ring and more preferably a cyclohexyl group from the viewpoint of controlling the charge amount. Further, the cycloalkyl group may have an alkyl group on its ring structure, but preferably does not have an alkyl group.

The resins contained in the resin coating layer may be used alone or may be in combination of two or more thereof. In the case of using two or more resins, the weight-average molecular weight of the one or more resins may be from 1,800,000 to 5,000,000. The resins may also be used as a copolymer of the monomers and the like described above.

The glass transition temperature (Tg) of the resin used in the resin coating layer is not particularly limited, but the temperature is preferably from 50° C. to 150° C., more preferably from 70° C. to 120° C., and even more preferably from 80° C. to 120° C.

The thermal decomposition starting temperature (TGA) of the resin used in the resin coating layer is not particularly limited, but the temperature preferably from 120° C. to 300° C., more preferably from 150° C. to 300° C., and particularly preferably from 200° C. to 300° C.

The glass transition temperature of the resin is determined by a differential scanning calorimeter (DSC) measurement method, and may be determined from the main maximum peak measured according to ASTM D3418-8. For the measurement of the main maximum peak, a DSC-7 (manufactured by Perkin-Elmer) is used. The temperature correction of the detecting portion of the device is carried out using the melting points of indium and zinc, and the correction of heat quantity is carried out using the heat of fusion of indium. An aluminum pan is used as a sample, an empty pan is used as a control, and the measurement is carried out at a temperature rising rate of 10° C./min. In addition, the TGA of the resin is calculated by measuring the weight loss portion in a nitrogen atmosphere using thermal decomposition device (the thermal cracking unit for gas chromatograph TGA-50 manufactured by Shimadzu Corporation).

Coating Resin Particles

The resin coating layer in the exemplary embodiment preferably contains resin particles.

The resin particles are preferably particles formed of resins as described above.

Further, the resin coating layer in the exemplary embodiment is preferably a layer formed of resin particles in which the weight average molecular weight thereof is from 1,800,000 to 5,000,000.

As a preparing method of the resin particles, there are methods in which the coating resin particles are synthesized by emulsion polymerization method or a suspension polymerization method or the like or after synthesis, the resin is obtained by pulverization and classification or emulsification and dispersion in water. It is preferable to use resin particles prepared by polymerizing and drying in an emulsion polymerization method using a polymerization initiator and a surfactant in the exemplary embodiment.

In the case where the resin coating layer contains resin particles in the exemplary embodiment, the resin particles may be present on at least a portion of the resin coating layer and the resin particles may be present on the surface side of the resin coating layer, but it is preferable that the resin particles may be present on the magnetic particle side of the resin coating layer.

The volume average particle diameter of the resin particles is preferably from 50 nm to 500 nm and more preferably from 100 nm to 300 nm.

If the volume average particle diameter of the resin particles is within the above range, the variation in the thickness of the resin coating layers of the finally obtained carrier is reduced and various additives are well dispersed. In addition, the uneven distribution of the composition of the resin coating layers of the carrier is reduced, which is effective in terms of the reduced performance and the reduced variation of the reliability. Further, the volume average particle diameter of the resin particles may be measured, for example, by cutting the carrier particles with a Microtome or the like and observing the resin particles remaining in the resin coating layer in cross-section with a scanning electron microscope and the like.

Method of Preparing Resin

In the case where the resin used in the exemplary embodiment is prepared by emulsion polymerization, the resin is preferably prepared by using persulfate polymerization initiators as a polymerization initiator. Specifically, for example, ammonium persulfate, sodium persulfate, potassium persulfate, and the like are exemplified, but it is preferable to control the sodium sulfate structure. Thus, it is preferable to use ammonium persulfate or sodium persulfate, and more preferable to use ammonium persulfate.

The amount of the radical polymerization initiator used in the preparation of the resin in the exemplary embodiment added is not particularly limited, but the amount is preferably from 0.01% by weight to 2.0% by weight and more preferably from 0.05% by weight to 0.50% by weight with respect to the total amount of the monomers.

Further, in a case of preparing resins by the emulsion polymerization method, the molecular weight adjustment of the resins may be carried out using a chain transfer agent. The chain transfer agent is not particularly limited, but specifically the resins may have a covalent bond between a carbon atom and a sulfur atom, and more specifically, n-alkyl mercaptans such as n-propyl mercaptan, n-butyl mercaptan, n-amyl mercaptan, n-hexyl mercaptan, n-heptyl mercaptan, n-octyl mercaptan, n-nonyl mercaptan, and n-decyl mercaptan; branched chain alkyl mercaptans such as isopropyl mercaptan, isobutyl mercaptan, s-butyl mercaptan, tert-butyl mercaptan, cyclohexyl mercaptan, tert-hexadecyl mercaptan, tert-lauryl mercaptan, tert-nonyl mercaptan, tert-octyl mercaptan, and tert-tetradecyl mercaptan; aromatic ring-containing mercaptans such as allyl mercaptan, 3-phenylpropyl mercaptan, phenyl mercaptan, and mercapto triphenyl methane; and the like are exemplified.

Surfactant

The resin coating layer used in the exemplary embodiment preferably contains a surfactant.

The surfactant is not particularly limited, but it is preferable to contain at least one selected from the group consisting of anionic surfactants, cationic surfactants, and nonionic surfactants. Among them, in the exemplary embodiment, persulfate polymerization initiators and anionic surfactant with excellent reactivity are preferable.

Specific examples of the anionic surfactant include fatty acid soaps such as potassium laurate, sodium oleate, and castor oil sodium; sulfuric esters such as octyl sulfate, lauryl sulfate, lauryl ether sulfate, and nonylphenyl ether sulfate; sulfonates such as lauryl sulfonates, dodecyl sulfonate, dodecylbenzene sulfonate, tri-isopropyl naphthalene sulfonate, and sodium alkyl naphthalene sulfonate such as dibutyl naphthalene sulfonate, naphthalene sulfonate formalin condensate, monooctyl sulfosuccinate, dioctyl sulfosuccinate, lauric acid amide sulfonate, and oleic acid amide sulfonate; phosphoric acid esters such as lauryl phosphate, isopropyl phosphate, and nonylphenyl ether phosphate, sulfosuccinates such as dialkyl sodium sulfosuccinates such as sodium dioctyl sulfosuccinate, disodium lauryl sulfosuccinate, and disodium lauryl polyoxyethylene sulfosuccinate; and the like.

The resin coating layer preferably contains a sulfo group in the exemplary embodiment, and preferably contains the alkylbenzene sulfonate as a surfactant. Specific examples thereof include sodium decylbenzene sulfonate, sodium undecyl benzene sulfonate, sodium dodecylbenzene sulfonate, sodium tridecylbenzene sulfonate, sodium tetradecyl benzene sulfonate, and the like. These alkyl benzene sulfonates may be used alone or may be used in mixed. Commercially available dodecylbenzene sulfonates are often a mixture of plural compounds among the compounds exemplified in the above specific examples.

Examples of cationic surfactants include amine salt compounds, quaternary ammonium salt compounds, and the like. Specific examples thereof include amine salts such as lauryl amine hydrochloride, stearyl amine hydrochloride, oleyl amine acetate, stearyl amine acetate, and stearyl aminopropyl amine acetates; quaternary ammonium salts such as lauryl trimethyl ammonium chloride, dilauryl dimethyl ammonium chloride, distearyl ammonium chloride, distearyl dimethyl ammonium chloride, lauryl dihydroxy ethylmethyl ammonium chloride, oleylbis polyoxyethylene methyl ammonium chloride, lauroyl aminopropyl dimethyl ethyl ammonium ethosulfate, lauroyl aminopropyl dimethyl hydroxyethyl ammonium perchlorate, alkylbenzene dimethyl ammonium chloride, and alkyl trimethyl ammonium chloride; and the like.

Specific examples of the nonionic surfactants include alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octyl phenyl ether, and polyoxyethylene nonylphenyl ether; alkyl esters such as polyoxyethylene laurate, polyoxyethylene stearate, and polyoxyethylene oleate; alkyl amines such as polyoxy ethylene lauryl amino ether, polyoxy ethylene stearyl amino ether, polyoxy ethylene oleyl amino ether, polyoxy ethylene soybean amino ether, and polyoxyethylene beef tallow amino ether; alkyl amides such as polyoxy ethylene lauric acid amide, polyoxy ethylene stearic acid amide, and polyoxy ethylene oleic acid amide; a vegetable oil ethers such as polyoxy ethylene castor oil ether, and polyoxy ethylene rapeseed oil ether; alkanol amides such as lauric acid diethanol amide, stearic acid diethanol amide, and oleic acid diethanol amide; sorbitan ester ethers such as polyoxy ethylene sorbitan monolaurate, polyoxy ethylene sorbitan monopalmitate, polyoxy ethylene sorbitan monostearate, and polyoxy ethylene sorbitan monooleate; and the like.

Charge Control Agent

As the carrier of the exemplary embodiment, examples of the charge control agent that may be contained in the resin coating layer include any of known compounds such as nigrosine dyes, benzo imidazole compounds, quaternary ammonium salt compounds, alkoxylated amine, alkylamide, molybdic acid chelate pigments, triphenylmethane compounds, salicylic acid metal salt complexes, azo chromium complexes, and copper phthalocyanine, and the like. Quaternary ammonium salt compounds, alkoxylated amine, and alkyl amide are particularly preferable.

The amount of the charge control agent used in the exemplary embodiment added is preferably from 0.001 parts by weight to 5 parts by weight and more preferably from 0.01 parts by weight to 0.5 parts by weight with respect to 100 parts by weight of magnetic particles.

Conductive Material

The resin coating layer may contain a conductive material.

Examples of the conductive material that may be added to the resin coating layer in the exemplary embodiment include metals such as carbon black, gold, silver and copper, or titanium oxide, zinc oxide, tin oxide, barium sulfate, aluminum borate, potassium titanate, tin oxide, tin oxide doped with antimony, indium oxide doped with tin, zinc oxide doped with aluminum, resin particles coated with metal, and the like.

The content of the conductive material is preferably from 0.01 parts by weight to 10 parts by weight and more preferably from 0.05 parts by weight to 5 parts by weight with respect to 100 parts by weight of the coating resin in order to set a carrier volume resistivity as the desired properties. If the content of the conductive material is 0.01 parts by weight or more, then the resistance adjustment effect may be obtained enough. Further, if the content is 10 parts by weight or less, the conductive material is less likely to be disengaged.

Thermosetting Resin Particles and Cross-Linked Resin Particles

The resin coating layer in the exemplary embodiment may contain thermosetting resin particles or crosslinked resin particles in order to increase the strength.

As a preparing method of the thermosetting resin particles and the crosslinked resin particles, there are methods in which the resin particles are synthesized by emulsion polymerization method or a suspension polymerization method or the like or after synthesis, the resin is obtained by pulverization and classification or emulsification and dispersion in water. It is preferable to use resin particles prepared by polymerizing and drying in an emulsion polymerization method using a polymerization initiator and a surfactant in the exemplary embodiment.

The thermosetting resin particles are not particularly limited as long as the particles are formed of the thermosetting resin, but the particles formed of a resin containing a nitrogen element are preferable. Among these, melamine resins, urea resins, urethane resins, guanamine resins, amide resins are preferable because they have high positive charging properties and high resin hardness and the decrease in charge amount due to the peeling of the resin coating layer is prevented.

As the thermosetting resin particles, commercially available products are possibly used, and, for example, EPOSUTA S (manufactured by Nippon Shokubai Co. Ltd., a melamine-formaldehyde condensation resin) and EPOSUTA MS (manufactured by Nippon Shokubai Co. Ltd., a benzoguanamine-formaldehyde condensation resin), and the like are exemplified.

The crosslinked resin particles are not particularly limited as long as the particles are a polymer of polymerizable monomers. For example, resins using at least one selected from styrene compounds having good charging controllability, (meth)acrylate compounds, and polyvinyl compound are preferable.

Examples of the styrene compounds include styrene, α-methyl styrene, and the like.

Examples of the (meth)acrylate compounds include (meth)acrylic acid, alkyl (meth)acrylate compounds, and the like. Examples of the alkyl (meth)acrylate compounds include alicyclic alkyl (meth)acrylate compounds such as methyl (meth)acrylate, ethyl (meth)acrylate, cyclohexyl (meth)acrylate, and the like.

Among these, homopolymers or copolymers of the alicyclic (meth)acrylate compound which have low hygroscopicity are more preferable. Examples of the alicyclic (meth) acrylate compounds include cyclohexyl methacrylate, and the like.

The crosslinked resin particles may contain a nitrogen-containing monomer in order to provide the charge-imparting effect, and examples thereof include dialkylaminoalkyl (meth)acrylates such as diethylaminoethyl (meth)acrylate, and dimethylaminoethyl (meth)acrylate; alkylaminoalkyl (meth)acrylates such as ethyl aminoethyl (meth)acrylate, and methyl aminoethyl (meth)acrylate; aminoalkyl (meth) acrylates such as aminoethyl (meth)acrylate; 1,2,2,6,6-pentamethyl-4-piperidyl=methacrylate, 2,2,6,6-tetramethyl-4-piperidyl=methacrylate, and the like.

Methods for forming a crosslinked structure in preparing cross-linked resin particles is not particularly limited, but a method of using a crosslinking agent such as a crosslinking monomer may be exemplified.

Specific examples of the crosslinking agent include aromatic polyvinyl compound such as divinylbenzene and divinyl naphthalene; polyvinyl esters of aromatic polycarboxylic acids such as divinyl phthalate, divinyl isophthalate, divinyl terephthalate, divinyl homophthalate, divinyl/trivinyl trimesate, divinyl naphthalene dicarboxylate, and divinyl biphenyl carboxylate; divinyl esters of nitrogen-containing aromatic compounds such as divinyl pyridine dicarboxylate; vinyl esters of unsaturated heterocyclic compound carboxylic acids such as vinyl pyromucate, vinyl furan carboxylate, vinyl pyrrole-2-carboxylate, and vinyl thiophenecarboxylate; (meth)acrylic acid esters of linear polyols such as butanediol methacrylate, hexanediol acrylate, octanediol methacrylate, decanediol acrylate, and dodecane diol methacrylate; (meth)acrylic acid esters of branched, substituted polyol such as neopentyl glycol dimethacrylate and 2-hydroxy-1,3-diacryloxy propane; polyethylene glycol di(meth)acrylate, polypropylene polyethylene glycol di(meth)acrylates; polyvinyl esters of polycarboxylic acids such as divinyl succinate, divinyl fumarate, vinyl/divinyl malate, divinyl diglycolate, vinyl/divinyl itaconate, divinyl acetone dicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, and divinyl brassylate; and the like.

In the exemplary embodiment, these cross-linking agents may be used alone or in a combination of two or more kinds. Further, among the above crosslinking agents, acrylate is preferable in order not to impair the chargeability of the coating resin, and linear polyol (meth)acrylic acid esters such as butanediol methacrylate, hexanediol acrylate, octanediol methacrylate, decanediol acrylate, and dodecanediol methacrylate; (meth)acrylic acid esters of branched and substituted polyol such as neopentyl glycol dimethacrylate and 2-hydroxy-1,3-diacryloxypropane; polyethylene glycol di(meth)acrylate, polypropylene polyethylene glycol di(meth)acrylates, and the like are preferably used.

The crosslinked resin particles in the exemplary embodiment may be prepared in the same manner as in the coating resin particles, and preferable embodiments of the preparing method are also the same.

The volume average particle diameter of the thermosetting resin particles and crosslinked resin particles in the exemplary embodiment is preferably 3 μm or less and more preferably from 10 nm to 1,000 nm. If the volume average particle diameter of each particle is 3 μm or less, the exposure of the resin coating layer is prevented, and the dispersion of other additives is satisfactorily performed, and an improvement of the performance and reliability is achieved. Further, the strength of the resin coating layer of the carrier is moderately maintained, and the wear at the long-term use is controlled.

The particle diameter of each particle of the thermosetting resin particles and crosslinked resin particles may be the same, and may be adjusted in consideration of the dispersibility and coating resin strength. The volume average particle diameter of both particles, for example, may be measured using a MICROTRAC or the like.

The content of the resin in the resin coating layer of the exemplary embodiment is preferably from 50% by weight to 100% by weight, more preferably from 60% by weight to 99.8% by weight, and even more preferably from 80% by weight to 99.8% by weight with respect to a total amount of the resin coating layer.

The content of the resin coating layer in the carrier for two-component developer of the exemplary embodiment is preferably from 0.1 parts by weight to 20 parts by weight, more preferably from 0.5 parts by weight to 10 parts by weight, and even more preferably from 1 part by weight to 5 parts by weight with respect to 100 parts by weight of the magnetic particles. If the content of the resin coating layer is 0.1 parts by weight or more, the surface exposure of the magnetic particles may be small, and the injection of development electric field may be prevented. Further, if the content of the resin coating layer is 20 parts by weight or less, the resin powder liberated from the resin coating layer is less, and the peeling of the resin powder peeled in the developer may be prevented from the initial stages.

In a method of measuring the total weight of the resin coating layer, 5 g of carrier and 50 g of chloroform are placed in a beaker, the resin coating layer is sufficiently dissolved in an ultrasonic dispersion machine, the magnetic particles from the beaker bottom is held using a magnet, and the toluene solution in which the resin coating layer is dissolved or dispersed is removed. Further, 50 g of chloroform is added to the remaining magnetic particles, the resin is further dissolved in the ultrasonic dispersion machine, the magnetic particles from the beaker bottom is held using a magnet, and the toluene solution in which the resin coating layer is dissolved or dispersed is removed again. Further, 50 g of methanol is added to the remaining magnetic particles, after stirring, after the magnetic particles are held using a magnet, and methanol is discharged, and each beaker is dried by the methanol. The weight of the magnetic particles after drying is measured and the total weight of the resin coating layer is set by the difference from the carrier weight.

Characteristics of Resin Coating Layer

The average thickness of the resin coating layer is from 0.1 μm to 10 μm, but preferably from 0.2 μm to 3 μm to express the volume resistivity of a carrier stabled over time. If the thickness is within the above range, a uniform and smooth resin coating layer is easily formed on the magnetic particle surface and the aggregation of the carrier each other is prevented.

The average thickness (μm) of the resin coating layer is measured by observing and analyzing carrier particles of the cross section cut with a microtome or the like using a scanning electron microscope.

The coverage of the magnetic particle surfaces with the resin coating layer is preferably closer to 100%, and more preferably 80% or more, and even more preferably 85% or more.

In addition, the coverage of the resin coating layer may be determined by XPS measurements. As the XPS measurement apparatus, for example, JPS80 (manufactured by JEOL Ltd.) is used and the measurements are performed using MgKα rays as an X-ray source and setting an acceleration voltage to 10 kV and the emission current to 20 mV. The measurements are performed for a main element constituting the resin coating layer (typically carbon) and a main element constituting the core material (for example, in the case where the core material is iron oxide materials such as magnetite, the core material is iron and oxygen) (hereinafter, a case is described on the premise that the core material is iron oxide). Here, the C1s spectrum is measured for the carbon, the $Fe2p_{3/2}$ spectrum is measured for the iron, and the O1s spectrum is measured for the oxygen. The element number ($A_C+A_O+A_{Fe}$) of carbon, oxygen, and iron is obtained based on the spectrum of each of these elements, the iron weight ratio (carrier) is obtained by the following Expression (B) from the obtained elemental number ratio of carbon, oxygen and iron, after the core material alone or the magnetic particles are coated with the resin coating layer, and then the coverage is obtained by the following Expression (C).

$$\text{Iron weight ratio (atomic \%)}=A_{Fe}/(A_C+A_O+A_{Fe})\times 100 \quad \text{Expression (B):}$$

$$\text{Coverage (\%)}=[1-(\text{iron weight ratio of the carrier})/(\text{Iron weight ratio of the car the core material alone})]\times 100 \quad \text{Expression (C):}$$

In the case of using a material other than iron oxide system as the magnetic particles, the spectrum of the metal elements constituting the core material other than oxygen is measured, and the coverage may be obtained by performing the calculation according to the above Expression (B) or Expression (C).

Properties of Carrier

The volume resistivity of the carrier according to the exemplary embodiment is preferably from $10^6$ Ω·cm to $10^{14}$ Ω·cm and more preferably from $10^8$ Ω·cm to $10^{13}$ Ω·cm at the time of 1,000 V corresponding to the upper and lower limits of normal development contrast potential in order to achieve high image quality. The carrier volume resistivity may be obtained conventional electrode plate type electric resistance measuring method which measures a current when a voltage is applied to the carrier particles sandwiched between the two plate electrodes.

If the volume resistivity of the carrier is $10^6$ Ω·cm or more, the reproducibility of fine lines is improved, the amount of the carriers to migrate to the photoreceptor (image holding member) is reduced, and the cracks on the photoreceptor are prevented. On the other hand, if the volume resistivity of the carrier is $10^{14}$ Ω·cm or less, the reproducibility of a black solid image and a halftone image is improved.

The volume average particle diameter of the carrier according to the exemplary embodiment is preferably from 20 μm to 100 μm. If the volume average particle diameter of the carrier is 20 μm or more, the development together with the toner is prevented, and if the diameter is 100 μm or less, charging the toner evenly becomes easy.

The volume average particle diameter of the carrier is measured using a laser diffraction/scattering type particle diameter distribution measurement device (LS Particle Size Analyzer: LS13 320, manufactured by Beckman-Coulter Inc.).

The shape factor SF1 of the carrier is preferably from 100 to 145. If the factor is within the above range, since an appropriate hardness of the magnetic brush may be maintained and the stirring efficiency of the developer may not be easily decreased, the charge control is easy. Further, the shape factor SF1 of the carrier units a value obtained by the following Expression (D).

$$SF1=100\pi\times(ML)^2/(4\times A) \quad \text{Expression (D):}$$

Here, ML is the maximum length of carrier particles and A is the projected area of the carrier particles. The maximum length and the projected area of the carrier particles are obtained by observing the sampled carrier particles on a glass slide with an optical microscope and performing image analysis with an image analyzer through a video camera (LUZEX III, manufactured by NIRECO Corporation). The sampling number in this case is 100 or more, and the shape factor represented by Expression (D) is determined using the average value.

The saturation magnetization of the carrier is preferably from 40 emu/g to 100 emu/g, and more preferably from 50 emu/g to 100 emu/g. As a measurement device of the magnetic properties, a vibrating sample type magnetic measurement device VSMP10-15 (manufactured by Toei Kogyo Co., Ltd.) is used. A measurement sample is packed in a cell of the inside diameter of 7 mm and the cell height of 5 mm and set in the device. The measurement is swept up to 1,000 oersteds by adding the applied magnetic field. Then, the applied magnetic field is decreased to prepare a hysteresis curve on a recording sheet. The saturation magnetization, the residual magnetization, and the coercive force may be obtained from the data of the curve. In the exemplary embodiment, the saturation magnetization shows a magnetization measured in a magnetic field of 1,000 oersteds.

Preparing Method of Electrostatic Charge Image Developing Carrier

The carrier of the exemplary embodiment may be prepared by applying a resin coating layer on the magnetic particle surfaces. The methods for coating formation are not particularly limited, but a method of coating (wet method) by a solution for forming a resin coating layer in which the resin forming a coating layer and, if necessary, various additives such as a charge control agent are dissolved or dispersed in a suitable solvent and a powder coating method (dry method) of heating and mixing the coating resin particles and the magnetic particles at high speed and then performing coating are exemplified.

Wet Method

The solvent used in the wet method is not particularly limited, and may be selected in consideration of the resin used, the coating applicability, and the like.

In the wet method, examples of the method of forming a concrete resin coating layer include a dipping method of dipping the magnetic particles of the carrier in the resin coating layer forming solution, a spray method of spraying a resin coating layer forming solution on the magnetic particle surface of the carrier, a fluidized bed method of spraying a resin coating layer forming solution in a state in which the magnetic particles of the carrier is suspended by the flowing air, and a kneader coater method that mixes the magnetic particles of the carrier and the resin coating layer forming solution and remove the solvent in a kneader coater.

However, since the weight average molecular weight becomes a high molecular weight, the viscosity of the resin coating layer forming solution is increased, and coating the fine resin particles uniformly becomes difficult.

The preparing method of the carrier for two-component developer of the exemplary embodiment preferably prepares carriers in the powder-coating method using resin particles as a resin forming the resin coating layer.

Dry Method

As the dry method, a preparing method of the carrier including the attaching step of mixing the magnetic particles with the coating resin particles, and obtaining a mixture in which the coating resin particles are attached to the surface of the magnetic particle is exemplified.

As the coated resin particles, the resin particles having a weight average molecular weight of 1,800,000 to 5,000,000 are preferably exemplified.

In the above attaching step, it is preferable to fix the coating resin particles onto the surface of the core magnetic particles by the mechanical impact force. As the device for mixing the magnetic particles with the coating resin particles, a known powder mixing apparatus may be possibly used in batchwise or continuous mode. As the batchwise, mixing apparatuses which are equipped with a stirrer such as HENSCHEL mixer and NAUTA mixer are preferably exemplified. In addition, as the continuous device, a single-screw or twin-screw type paddle mixer, a ribbon mixer, and an extrusion mixer are exemplified, but the invention is not limited thereto.

The mixing temperature when mixing is preferably near the glass transition temperature of the coating resin contained in the coating resin particles.

In the exemplary embodiment, a method of incorporating the charge control agent to the resin coating layer is not particularly limited. The charge control agent may be added after mixing with the coating resin particles in advance or may be added separately, but mixing in advance is preferable to obtain a uniform structure thereof. In addition, the charge control agent may be added in several portions by changing the composition ratio for controlling the resin coating layer structure. In the exemplary embodiment, a method of incorporating the conductive materials in the resin coating layer is not particularly limited. The conductive materials may be added after mixing with the coating resin particles in advance or may be added separately, but mixing in advance is preferable to obtain a uniform structure thereof. Further, the conductive materials may be added in several portions by changing the composition ratio for controlling the resin coating layer structure. Moreover, in the exemplary embodiment, a method of incorporating the thermosetting resin particles and the cross-linked resin particles in the resin coating layer is not particularly limited, and a method of further incorporating the thermosetting resin particles and the cross-linked resin particles during mixing the magnetic particles and the coating resin particles may be exemplified.

In addition, the preparing method of the carrier in the exemplary embodiment preferably further includes a heating step of heating the mixture above the glass transition temperature.

By conducting the heating step, a polymerization initiator remaining on the resin coating layer, in particular, the remaining polymerization initiator of persulfate is decomposed, and further the sulfides other than the sulfate is discharged as sulfur dioxides, and the remaining amount of the resin coating layer may be adjusted.

The heating temperature is preferably a thermal decomposition initiation temperature (TGA) of resin particles from a glass transition temperature (Tg).

Among them, a preparing method of the carrier for two-component developer of the exemplary embodiment is preferably a preparing method which includes:

an attaching step of mixing the magnetic particles and the resin particles so that the resin particles attach on the surface of the magnetic particle, and heating step for forming a resin coating layer, which includes:

charging the magnetic particles onto which the resin particles are attached in a continuous heat treatment apparatus from the raw material supply port thereof, wherein the continuous heat treatment apparatus includes a rotator in which a rotating shaft is provided in the same direction as the traveling direction from a raw material supply port toward an outlet in a casing having the raw material supply port and the outlet and is capable of controlling the temperature of each portion of the casing, and heating the magnetic particles onto which the resin particles are attached to melt the resin particles while passing the particles between the casing and the rotator.

Each portion of the apparatus used in the heating step will be described below.

The continuous heat treatment apparatus has a casing having a raw material supply port and an outlet, and the temperature of each portion of the casing may be controlled by providing a rotator in which a rotating shaft is disposed in the same direction as the traveling direction from a raw material supply port toward an outlet in the casing.

The position of the raw material supply port and the outlet in the casing is not particularly limited as long as the raw material charged into the apparatus passes between the inner wall of the casing and the rotator and if the coating formation step may be conducted at the position, but it is preferable that the raw material supply port is present near one end of the rotator and the outlet is present near the other end of the rotator.

Further, the continuous type heat treatment apparatus has heating units capable of controlling the temperature of each portion of the casing, and further may have cooling units for cooling a part of the casing for the temperature control.

In addition, the casing in the continuous heat treatment apparatus preferably has a jacket structure as the heating units and the cooling units. By having the jacket structure, it is easy to adjust heating and cooling temperature from the outside. Further, the jacket structure may be preferably provided at the outside of the casing or the rotator, or may be preferably provided on both of the outside of the casing and the rotator.

Moreover, the continuous type heat treatment apparatus preferably has a single-screw or twin-screw rotator in the casing.

The rotator, if desired, may control the agitation shear force. For example, the agitation shear force by the rotator may be easily controlled by changing the shape and the stirring speed of the rotator depending on the portion of the rotator, or by changing the casing shape without changing the rotator, or by a clearance between the rotor and the casing.

Specific examples of the continuous heat treatment apparatus used in the exemplary embodiment include paddle mixers, screw mixers, TURBULIZER, continuous kneader, and a twin-screw extrusion kneader which is provided with heating and cooling units, but the invention is not limited thereto. Among these, a twin-screw extrusion kneader which the heating and cooling units are disposed on each portion the traveling direction from a raw material supply port toward an outlet may preferably be exemplified.

In the heating step, the charging rate to the continuous heat treatment apparatus of the magnetic particles in which resin particles are attached may be selected less than the transferring capability of the heat treatment apparatus or lower. If the charging rate is the transferring capability of the apparatus or lower, the occurrence of clogging is prevented and the driving system of the apparatus does not become overloaded. Thus, the continuous operation of the apparatus occurs easily. Preferably, for the transferring capacity of the heating apparatus, the charging rate may be selected such that the charged ratio of the treated product in the clearance between the rotator and the casing of the heating apparatus is 100% or less. The higher the charged ratio is, the better the heat transfer efficiency becomes. Thus, processing capacity is increased.

Further, the method of charging the mixed product may be carried out intermittently or may be carried out continuously, but it is better to provide the mixed product while maintaining the temperature of the mixed product in the attaching step. In order to increase the processing capacity of the heating step, the temperature of the mixed product may be further preheated. Specifically, for example, the insulating material may be wound onto the mixed product supply hopper or the jacketed hopper may be heated by the heat medium.

It is important to perform continuously a heating treatment in heating step for the uniform coating layer formation.

In the heating step, the magnetic particles on which the charged resin particles are attached are heated by the heating units while being stirred by the rotator, and the attached resin particles are melted to form a resin coating layer on the magnetic particle surface.

Further, in the heating step, to pass the magnetic particles with resin particle-attached layer between the inner wall of the casing and the rotator is carried out by rotating the rotator and by stirring the magnetic particles with resin particle-attached layer.

In the heating step, the inner wall temperature of the outlet portion of the heat-melted product is preferable to satisfy the following Expression 1. In the above embodiments, the thickness of the sufficient resin coating layer is obtained, and peeling of the resin coating layer may be prevented. Thus, the resin particles having the weight average molecular weight of even 1,800,000 or more may be uniformly coated.

Glass transition temperature of resin particles ($Tg$)+ 50° C.<Inner wall temperature of outlet portion of heat-melted product≤Thermal decomposition starting temperature of resin particles ($TGA$) Expression 1

Furthermore, in the heating step, the inner wall temperature of the raw material supply port and the inner wall temperature of the outlet portion of the heat-melted product are preferable to satisfy the following Expression 2. In the above embodiments, peeling of the resin coating layer is further prevented, and the production treatment capability of the carrier is excellent.

Inner wall temperature of outlet portion of heated-melting product<Inner wall temperature of raw material supply portion (° C.)≤$TGA$+100° C. Expression 2

In the exemplary embodiment, the inner wall temperature of the outlet portion of the heat-melted product and the inner wall temperature of the casing refers to a casing part in the range described in Expressions 1 and 2, and the length of the casing from the raw material supply port in the rotating shaft direction of the rotator to the outlet portion of the heat-melted product is preferable to be 1/10 or longer in length of the casing portion. That is, the length of the casing section (low-temperature portion) in which the inner wall temperature is lower than the inner wall temperature of the raw material supply port is preferable to be 1/10 or longer in length with respect to the entire length of casing in the rotation axis direction of the rotator.

In addition, the length of the low-temperature portion is preferable to be 1/8 or longer in length, and more preferable to be 1/4 or longer in length, with respect to the length of casing in the rotation axis direction of the rotator.

In addition, the inner wall temperature of the outlet portion of the heat-melted products is preferably (Tg+50° C.) to a thermal decomposition starting temperature of the resin particles and more preferably a thermal decomposition starting temperature of the resin particles to (Tg+80° C.). If the inner wall temperature of the raw material supply port is within the range of the above temperature, the resin particles are heated and melted in a short time. Although detailed mechanism thereof is not known, it is estimated that the adhesion between the resin coating layer and the magnetic particles is excellent and the peeling of the resin coating layer is more prevented.

In addition, the inner wall temperature of the outlet portion of the heat-melted products is preferably the thermal decomposition starting temperature of the resin particles or lower, more preferably thermal decomposition starting temperature of the resin particles or lower and from 150° C. to 270° C., even more preferably thermal decomposition starting temperature of the resin particles or lower, and from 180° C. to 260° C., and particularly preferably thermal decomposition starting temperature of the resin particles or lower and from 200° C. to 250° C.

The inner wall temperature of the raw material supply port is preferably from 200° C. to 400° C., more preferably from 250° C. to 370° C., even more preferably from 280° C. to 360° C., and particularly preferably from 300° C. to 350° C.

In the heating step, the inner wall temperature of the casing may be changed stepwise from the raw material supply port to the outlet port or changed continuously. Further, in the heating step, it is preferable that the inner wall temperature of the casing is highest at the inner wall temperature of the material supply port and lowest at the inner wall temperature of the outlet according to the rotational axis of the rotator.

Further, in the heating step, it is preferable that the inner wall temperature varies from 2 to 4 steps in the entire casing.

A preparing method of the carrier for two-component developer of the exemplary embodiment preferably includes a cooling and crushing step for obtaining the magnetic particles having a resin coating layer by conducting the cooling and crushing treatments on the heat-melted products obtained by the heating step.

In the heating step, since the material that ejected from the outlet port and then heated and melted (in the exemplary embodiment, also referred to as a heat-melted product.) forms agglomerates in the particle with each other, in the case of just standing the product at room temperature (for example, under an atmosphere of 5° C. to 35° C.), the product solidifies in the state of aggregate. Therefore, a step of crushing is necessary to the primary particles.

In the cooling and crushing step, the magnetic particles having a resin coating layer is obtained by crushing the primary particles through cooling, stirring, and the like.

In the cooling and crushing step, the crushing treatment may be conducted simultaneously with the cooling step, or conducted continuously after the cooling step, or cooling step may be conducted after crushing step, but conducting the cooling and crushing step simultaneously or conducting the crushing step before cooling step is before the particles are solidified to each other, and thus preferable in the viewpoint of preventing the peeling of the resin coating layer.

The cooling units and the crushing units used in the cooling and crushing step are not particularly limited and known methods are used. In addition, the cooling in the cooling crushing step may be conducted by simply standing the products at room temperature (for example, under an atmosphere of 5° C. to 35° C.), without an aggressive cooling.

The cooling treatment in the cooling and crushing step may be batchwise or continuous mode. If the cooling treatment is batchwise, a mixing apparatus equipped with a stirrer such as HENSCHEL mixer or NAUTA mixer having a jacket cooling mechanism is preferably used. If the cooling treatment is in continuous mode, a single-screw or twin-screw type paddle mixer, a ribbon mixer, an extrusion mixer which has jacket cooling mechanism is exemplified.

The crushing treatment in the cooling and crushing step also may be batchwise or continuous mode. If the crushing treatment is batchwise, the fast stirring and mixing apparatus such as HENSCHEL mixer is preferably used. If the crushing treatment is in continuous mode, pin mill, an extrusion mixer, and the like are exemplified.

The apparatus used for cooling and crushing step may have separately a cooling apparatus and a crushing apparatus, and may be an integral-type apparatus for performing the cooling and crushing step simultaneously. The apparatus may be a continuous heating apparatus and cooling apparatus or a crushing device apparatus, or may be an integral-type apparatus with the cooling crushing apparatus.

The preparing method of the carrier for two-component developer of the exemplary embodiment, as necessary, may include other known processes.

The preparing method of the exemplary embodiment, as necessary, may include, a classification step of classifying the magnetic particles having the obtained resin coating layer and/or a sieving step of sieving the magnetic particles having the obtained resin coating layer after the cooling and the crushing steps.

The classification units and sieves used in the classification step and the sieving step are not particularly limited, and, if desired, the known units and sieves may be used.

An example of a continuous heat treatment apparatus suitably used in the preparing method of carrier for two-component developer of the exemplary embodiment will be described below with reference to the drawings.

In the continuous heat treatment apparatus 10 shown in the FIGURE, the magnetic particles onto which the resin particle particles are attached are charged through a raw material supply port 16 in the casing 14 from a particle supply device 12. In addition, the continuous heat treatment apparatus 10 is a twin-screw extrusion kneader. Magnetic particles onto which the resin particles are attached are charged by rotating the rotator 18, passed between the casing 14 and the rotor 18, passed through the heating treatment units A to D, and the heat-melted product 22 which contains an aggregate of the magnetic particles having the resin coating layer is ejected to an outlet 20. Further, the particles are also subjected to receiving the disintegration treatment by rotating the rotator 18. The rotator 18 shown in the FIGURE is a rotator entirely having a helical screw shape.

A jacket (not shown) capable of partial temperature control is wound on the outer peripheral portion of the casing 14 in the heating treatment units A to D by the heating units and cooling units. The temperature control of the heating treatment units A to D is performed by the jacket. Further, the heating treatment units A to D in a continuous type heat treatment apparatus 10 are provided continuously, and the inner wall temperature of the heating treatment unit D (outlet portion of the heat-melted product) is preferably lower than the inner wall temperature of the heating treatment unit A (raw material supply port).

Further, the inner wall temperatures $T_A$ to $T_D$ of each of the heating treatment units A to D are preferable to satisfy the Expressions 3 and 4 below.

$$T_A > T_D \quad \text{Expression 3}$$

$$T_A \geq T_B \geq T_C \geq T_D \quad \text{Expression 4}$$

In a continuous heat treatment apparatus 10 shown in the FIGURE, the heating treatment unit performs the temperature adjustment in the quadrant division of the A to D, the invention is not restricted thereto, and the temperature adjustment in multistage is possible in accordance with the casing length.

Two-Component Developer

Two-component developer (simply, referred to as "developer") of the exemplary embodiment contains the carrier for two-component developer of the exemplary embodiment and a toner.

Further, the two-component developer of the exemplary embodiment is preferably an electrostatic charge image developer.

The toner used in the exemplary embodiment is not particularly limited, a known toner is used, and an electrostatic charge image developing toner is suitably used.

The mixing ratio between the toner and the carrier in the two-component developer of the exemplary embodiment is not particularly limited and may be appropriately selected depending on the purpose, but the mixing ratio (weight ratio) between the toner and the carrier is preferably in the range of toner:carrier=1:100 to 30:100, and more preferably in the range of toner:carrier=3:100 to 20:100.

Toner for Developing Electrostatic Charge Images

The toner used in the exemplary embodiment is configured to include toner particles, and, as necessary, an external additive.

Toner Particles

The toner particles are configured to include, for example, a binder resin, and, as necessary, a colorant, a release agent, and other additives.

Binder Resin

Examples of the binder resin include vinyl resins composed of homopolymers of monomers such as styrenes (for example, styrene, para-chloro styrene, α-methyl styrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like), ethylenically unsaturated nitriles (for example, acrylonitrile, methacrylonitrile, and the like), vinyl ethers (for example, vinyl methyl ether, vinyl isobutyl ether, and the like), vinyl ketones (vinyl methyl ketone, vinyl ethyl ketone, vinyl isopropenyl ketone, and the like), olefins (for example, ethylene, propylene, butadiene, and the like) or copolymers that combine two or more kinds of these monomers.

Examples of the binder resin include non-vinyl resins such as epoxy resins, polyester resins, polyurethane resins, polyamide resins, cellulose resins, polyether resins, and modified rosin, mixtures of these resins and the vinyl resins or, graft polymers obtained by polymerizing vinyl monomers under the coexistence of these resins.

These binder resins may be used alone or in a combination of two or more kinds.

The binder resin is preferably a polyester resin.

As the polyester resins, for example, known polyester resins are exemplified.

Examples of the polyester resins include a condensation polymer of polyvalent carboxylic acid and polyol. Further, as the polyester resin, a commercially available resin may be used or synthesized resins may be used.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, sebacic acid, and the like), alicyclic dicarboxylic acids (for example, cyclohexane dicarboxylic acid, and the like), aromatic dicarboxylic acids (for example, terephthalic acid, isophthalic acid, phthalic acid, naphthalene dicarboxylic acid, and the like), anhydrides of these acids, their lower alkyl esters (for example, having 1 to 5 carbon atoms), and the like. Among these, for example, aromatic dicarboxylic acids are preferable as polycarboxylic acids.

Polyvalent carboxylic acids may use trivalent or higher carboxylic acid having a crosslinked structure or branched structure along with dicarboxylic acids. Examples of the trivalent or higher carboxylic acids include trimellitic acid, pyromellitic acid, anhydrides of these acids, their lower alkyl esters (for example, having 1 to 5 carbon atoms), and the like.

Polyvalent carboxylic acids may be used alone or in a combination of two or more kinds.

Examples of the polyols include aliphatic diols (for example, ethylene glycol, diethylene glycol, triethylene glycol, propylene glycol, butane diol, hexane diol, neopentyl glycol, and the like), alicyclic diols (for example, cyclohexane diol, cyclohexane dimethanol, hydrogenated bisphenol A, and the like), and aromatic diol (for example, ethylene oxide adduct of bisphenol A, propylene oxide adduct of bisphenol A, and the like). Among these, as polyols, for example, aromatic diols and alicyclic diols are preferable, and aromatic diols are more preferable.

The polyol may use trivalent or higher polyols having a crosslinked structure or branched structure along with the diols. Examples of the trivalent or higher polyols include glycerin, trimethylol propane, and pentaerythritol.

The polyols may be used alone or in a combination of two or more kinds.

The glass transition temperature (Tg) of the polyester resin is preferably from 50° C. to 80° C. and more preferably from 50° C. to 65° C.

The glass transition temperature is determined from a DSC curve obtained by the differential scanning calorimetry (DSC), and more specifically determined by "extrapolated onset glass transition temperature" described in the method of obtaining the glass transition temperature of JIS K7121-1987 "Testing methods for transition temperatures of the plastics". The weight average molecular weight (Mw) of the polyester resin is preferably from 5,000 to 1,000,000 and more preferably from 7,000 to 500,000.

The number average molecular weight (Mn) of the polyester resin is preferably from 2,000 to 100,000.

The molecular weight distribution (Mw/Mn) of the polyester resin is preferably from 1.5 to 100 and more preferably from 2 to 60.

Further, the weight average molecular weight and the number average molecular weight are measured by gel permeation chromatography (GPC). The measurement of the molecular weight by GPC is carried out by using GPC HLC-8120GPC (manufactured by TOSOH CORPORATION) as a measurement device and Column TSKgel SUPERHM-M (15 cm) (manufactured by TOSOH CORPORATION), and THF solvent. The weight average molecular weight and number average molecular weight are calculated using a molecular weight calibration curve prepared by monodisperse polystyrene standard sample from the measurement results.

Polyester resin is obtained by a known preparation method. Specifically, for example, the resin is obtained by setting a polymerization temperature of 180° C. to 230° C. and as necessary, reducing the pressure in the reaction system, and performing a reaction while removing water and alcohol generated during condensation.

In the case where the monomer of the raw materials is not dissolved or compatible at the reaction temperature, a solvent having a high boiling point may be added to be dissolved as a dissolution aid. In this case, the polycondensation reaction is performed while distilling off the dissolution aid. In the case where the monomer having poor compatibility exists in the copolymerization reaction, the monomer may be polycondensed with the main component after condensing the monomer having poor compatibility and the acid or alcohol which is scheduled to be polycondensed with the monomer in advance.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brillouin carmine 6B, Du Pont oil red, pyrazolone red, lithol red, rhodamine B lake, lake red C, pigment red, rose Bengal, aniline blue, ultramarine blue, calco oil blue, methylene blue chloride, phthalocyanine blue, Pigment blue, phthalocyanine green, and malachite green oxalate, or various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane, and thiazole.

The colorants may be used alone, or in a combination of two or more kinds.

As the colorant, as necessary, the surface-treated colorant may be used, and the colorant may be used in a combination with the dispersant. Further, the colorant may be used in a combination of plural kinds.

The content of the colorant is, for example, is preferably from 1% by weight to 30% by weight and more preferably from 3% by weight to 15% by weight with respect to the entire toner particles.

Release Agent

Examples of the release agent include hydrocarbon wax; Natural wax such as carnauba wax, rice wax, and candelilla wax; synthetic or mineral and petroleum waxes such as montan wax; ester type such as fatty acid esters and montanic acid ester waxes; and the like. The release agent is not limited thereto.

The melting temperature of the release agent is preferably from 50° C. to 110° C., and more preferably from 60° C. to 100° C.

The melting temperature is determined from a DSC curve obtained by the differential scanning calorimetry (DSC) by "melting peak temperature" described in the method of obtaining the melting temperature of JIS K-1987 "Testing methods for transition temperatures of the plastics".

The content of the release agent is, for example, preferably from 1% by weight to 20% by weight, and more preferably from 5% by weight to 15% by weight with respect to the entire toner particles.

Other Additives

Examples of the other additives include well-known additives such as magnetic materials, charge control agents, inorganic powder, and the like. These additives may be contained in the toner particles as an internal additive.

Characteristics of Toner Particles and the Like

The toner particles may be toner particles having a single-layered structure, or toner particles of the so-called core-shell structure constituted by the core (core particles) and the resin coating layer (shell layer) coating the core.

Here, the toner particles of the core-shell structure are, for example, preferably configured to include a core which is configured to include, a binder resin and, as necessary, other additives such as a colorant and a release agent, and a resin coating layer which is configured to include a binder resin.

The volume average particle diameter ($D_{50v}$) of toner particles is preferably from 2 μm to 10 μm and more preferably from 4 μm to 8 μm.

The various average particle diameter and various particle diameter distribution index of the toner particles are measured using COULTER MULTISIZER-II (manufactured by Beckman Coulter, Inc.) and using ISOTON-II (manufactured by Beckman Coulter, Inc.) as an electrolyte.

In the measurement, 0.5 mg to 50 mg of a measurement sample is added to 2 ml of 5% aqueous solution of a surfactant (sodium alkylbenzenesulfonate is preferable) is added as a dispersant. This solution is added to 100 ml to 150 ml of the electrolyte.

Electrolyte in which the sample is suspended is subjected to dispersion treatment with an ultrasonic dispersing device for 1 minute, and the particle diameter distribution of the particles having the particle size of the range of 2 μm to 60 μm is measured using an aperture with 100 μm of an aperture diameter by a COULTER MULTISIZER II. The number of sampling particles is 50,000.

Each of the volume and the number for the particle size range (channel) that is divided based on the particle diameter distribution to be measured is drawn as a cumulative distribution from the small diameter side, the particle diameter to become cumulative 16% is defined as the volume particle diameter $D_{16v}$ and the number particle diameter $D_{16p}$, the particle diameter to become cumulative 50% is defined as the volume average particle diameter $D_{50v}$ and cumulative number average particle diameter $D_{50p}$, and the particle diameter to become cumulative 84% is defined as the volume particle diameter $D_{84v}$ and the number particle diameter $D_{84p}$.

The volume average particle diameter distribution index ($GSD_v$) is calculated as $(D_{84v}/D_{16v})^{1/2}$, and the number average particle diameter distribution index ($GSD_p$) is calculated as $(D_{84p}/D_{16p})^{1/2}$ using these values.

The average circularity of the toner particles is preferably from 0.88 to 0.98 and more preferably from 0.92 to 0.97.

The average circularity of the toner is preferably measured by FPIA-3000 (manufactured by Sysmex Corporation). In this device, a method of measuring the particles which are dispersed in water or the like by a flow type image analysis method is employed, the aspirated particle suspension is introduced into a flat sheath flow cell, and formed into the flat sample flow by sheath liquid. The particles passing through the objective lens of a CCD camera are captured as a still image by irradiating the sample flow with strobe light. Circularity from the projected area and the perimeter is calculated by performing two-dimensional image treatment of the captured particle image. The average circularity is determined by statistical processing through the image analysis of each of at least 4,000 or more images with respect to the circularity.

$$\text{Circularity}=\text{circle equivalent diameter perimeter/perimeter}=[2\times(A\pi)^{1/2}]/PM$$

In the above expression, A represents a projected area and PM represents a perimeter.

The measurement is performed using the HPF mode (high-resolution mode), and the dilution ratio is 1.0 times. Moreover, the number particle size analysis range is set to 2.0 μm to 30.1 μm, and the circularity analysis range is set to in the range of 0.40 to 1.00 in the analysis of data for the purpose of measuring noise removal.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, and the like.

As the external additive in the exemplary embodiment, an external additive having the volume average particle diameter of 50 nm to 200 nm is particularly preferably used in view of obtaining a long-term stable printing quality. The external additives of this particle size range have a tendency to easily occur embedding to the carrier surface, deformation, polishing, and the like.

However, in the exemplary embodiment, in the case of using a toner having an external additive of the particle diameter range, the wear of the resin coating layer of the carrier is adequately controlled, and thus, the image defect such as deletion and the like is prevent.

The treatment with a hydrophobizing agent is preferably applied on the surface of the inorganic particles as an external additive. The treatment with the hydrophobizing agent may be performed, for example, by dipping the inorganic particles in the hydrophobizing agent. The hydrophobizing agent is not particularly limited, but examples thereof include silane coupling agents, a silicone oil, titanate coupling agents, aluminum coupling agents, and the like. These agents may be used alone or in a combination of two or more kinds.

The amount of the hydrophobizing agent is, for example, typically is from 1 part by weight to 10 parts by weight with respect to 100 parts by weight of the inorganic particles.

As the external additive, resin particles (resin particles such as polystyrene, polymethyl methacrylate (PMMA), and melamine resin), a cleaning aid (for example, metal salts of higher fatty acids represented by zinc stearate, and the particles of fluorine high molecular weight material), and the like may also be exemplified.

The amount of the external additive externally added is, for example, preferably from 0.01% by weight to 5% by weight and more preferably from 0.01% by weight to 2.0% by weight with respect to the toner particles.

Preparing Method of Toner

Next, a preparing method of the toner according to the exemplary embodiment will be described.

The toner according to the exemplary embodiment is obtained by externally adding an external additive with respect to the toner particles after preparing the toner particles.

Toner particles may be prepared by either of a dry method (for example, kneading and pulverizing method, or the like) or a wet method (for example, aggregation coalescence method, suspension polymerization method, dissolution suspension method, or the like). The preparing method of the toner particles is not particularly limited to thereto, but well-known methods are employed.

Among these, the aggregation coalescence method is preferable to obtain the toner particles.

Specifically, for example, in the case of preparing the toner particles by the aggregation coalescence method, the toner particles are prepared through a step of preparing the resin particle dispersion in which the resin particles to be a binder resin are dispersed (resin particle dispersion preparation step), a step of forming the aggregated particles (aggregated particles forming step) by aggregating the resin particles (as necessary, other particles) in the resin particle dispersion (as necessary, in the dispersion after mixing with other particle dispersion), and a step of forming the toner particles (coalescence step) by heating the aggregation particle dispersion in which aggregation particles are dispersed and coalescing the aggregated particles.

Hereinafter, details of each process will be described.

In the following description, a method of obtaining the toner particles including a colorant and a release agent will be described, and colorants and release agents may be used, as necessary. Of course, other additives other than colorants and release agents may also be used.

Resin Particle Dispersion Preparation Step

First, for example, a colorant particle dispersion in which the colorant particles are dispersed and a release agent particle dispersion in which the release agent particles are dispersed are prepared with the resin particle dispersion in which the resin particles to be the binder resin are dispersed.

Here, the resin particle dispersion is, for example, prepared by dispersing the resin particles in a dispersion medium by a surfactant.

The dispersion medium used in the resin particle dispersion is, for example, an aqueous medium.

Examples of the aqueous medium include water such as distilled water and ion-exchanged water, alcohols, and the like. These media may be used alone or in a combination of two or more kinds.

Examples of the surfactant include anionic surfactants such as sulfuric ester salts, sulfonate salts, phosphoric acid esters, and soaps; cationic surfactants such as amine salts, and quaternary ammonium salts; nonionic surfactants such as polyethylene glycol, alkylphenol ethylene oxide adducts, and polyols; and the like. Among these, particularly anionic surfactants and cationic surfactants are exemplified. Nonionic surfactants may be used in combination with anionic surfactants or cationic surfactants.

Surfactants may be used alone or in a combination of two or more kinds.

Examples of a method of dispersing the resin particles in the dispersion medium of the resin particle dispersion include general dispersing methods such as a rotary shearing type homogenizer, or a ball mill, a sand mill, and a DYNO mill having a media. Further, for example, resin particles may be dispersed in the resin particle dispersion by using a phase inversion emulsification method, depending on the type of resin particles.

Further, the phase inversion emulsification method is a method where a resin to be dispersed is dissolved in hydrophobic organic solvent in which the resin is soluble, a base is added to an organic continuous phase (O phase) to neutralize the solution, the aqueous medium (W phase) is placed thereto to conduct the conversion of the resin (so-called phase inversion) from W/O to O/W, and the discontinuous phased-resin is dispersed in an aqueous medium in particles shapes.

The volume average particle diameter of the resin particles which are dispersed in the resin particle dispersion is, for example, preferably from 0.01 μm to 1 μm, more preferably from 0.08 μm to 0.8 μm, and even more preferably from 0.1 μm to 0.6 μm.

Further, the volume average particle diameter of the resin particles are measured using the particle diameter distribution obtained by the measurement of the Laser diffraction particle diameter distribution measurement device (for example, LA-700 manufactured by Horiba, Ltd.), subtracting the cumulative distribution from the small particle diameter side for the volume with respect to the divided particle size ranges (channels), and setting the particle diameter at 50% cumulative with respect to the total particles as the volume average particle diameter $D_{50v}$. Even the volume average particle diameter of the particles in another dispersion is also measured in the same manner.

The content of the resin particles included in the resin particle dispersion is, for example, preferably from 5% by weight to 50% by weight and more preferably from 10% by weight to 40% by weight.

Further, for example, a colorant particle dispersion and a release agent particle dispersion are also prepared in the same manner as the resin particle dispersion. In other words, with respect to the volume average particle diameter of the particles, the dispersion medium, the dispersion method, and the content of the particles in the resin particle dispersion, the colorant particles dispersed in the colorant particle dispersion, and the release agent particles dispersed in the release agent particle dispersion are the same.

Aggregating Particle Forming Step

Next, the colorant particle dispersion and the release agent particle dispersion are mixed with the resin particle dispersion. Then, the aggregating particles which include the resin particles, the colorant particles, and the release agent particles and have diameters close to the diameter of the toner particles for the purpose of hetero-aggregating the resin particles, the colorant particles, and the release agent particles in the mixed dispersion are formed.

Specifically, aggregating particles are formed, for example, by adjusting the pH of the mixed dispersion to acidity (for example, a pH of 2 to 5), if necessary, after adding the dispersion stabilizer, heating the mixed dispersion to a temperature of the glass transition temperature of the resin particles (Specifically, for example, a glass transition temperature of resin particles—30° C. to glass transition temperature—10° C.) to aggregate the particles dispersed in the mixed dispersion, along with adding an aggregating agent to the mixed dispersion.

In the aggregating particle forming step, for example, the aggregating agent is added at room temperature (for example 25° C.) with stirring the mixed dispersion using a rotary shearing type homogenizer, the pH of the mixed dispersion is adjusted to acidity (for example, a pH of 2 to 5), if necessary, a dispersion stabilizer is added, and then the heating may be carried out.

Examples of the aggregating agent include a surfactant used as a dispersant to be added to the mixed dispersion, or a surfactant having reverse polarity, for example, inorganic metal salt, divalent or higher metal complexes, and the like. Particularly, in the case of using a metal complex as an aggregating agent, the amount of the surfactant used is reduced, and the charging characteristics are improved. Additives which form complexes with metal ions of the aggregating agent or similar bonds may be used, if necessary. As the additive, a chelating agent is preferably used.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

As the chelating agent, a water-soluble chelating agent may be used. Examples of the chelating agent include oxycarboxylic acids such as tartaric acid, citric acid, and gluconic acid; iminodiacetic acid (IDA), nitrilotriacetic acid (NTA), ethylenediaminetetraacetic acid (EDTA), and the like.

The amount of the chelating agent added is, for example, preferably from 0.01 parts by weight to 5.0 parts by weight, and more preferably 0.1 parts by weight or more and less than 3.0 parts by weight with respect to 100 parts by weight of the resin particles.

Coalescence Step

Next, toner particles are formed by heating the aggregating particle dispersion in which the aggregating particles are dispersed to the glass transition temperature of the resin particles or higher (for example, equal to or higher than the temperature of 10° C. to 30° C. higher than the glass transition temperature of the resin particles) and coalescing the aggregating particles.

The toner particles are obtained through the above steps.

Further, the toner particles may be prepared through a step of forming a second aggregated particles in which, after obtaining the aggregating particle dispersion liquid in which the aggregating particles are dispersed, the corresponding aggregating particle dispersion and resin particle dispersion in which the resin particles are dispersed are further mixed and aggregated so as to attach the resin particles on the surface of the aggregating particles, and a step of forming toner particles having a core/shell structure by heating the second aggregating particle dispersion in which the second aggregated particles are dispersed and coalescing the second aggregated particles.

The toner particles which are formed in the solution after the coalescence step is completed are subjected to the known cleaning steps, the solid-liquid separation step, and the drying step to obtain the toner particles in the dry state.

The washing step is preferably subjected to sufficient replacement washing with ion-exchanged water from the viewpoint of chargeability. Further, the solid-liquid separation step is not particularly limited, but the separation step preferably includes suction filtration, pressure filtration, or the like from the viewpoint of productivity. Further, although the drying step is not particularly limited, the drying step is preferably subjected to freeze drying, flash jet drying, fluidized drying, vibratory fluidized drying, or the like from the viewpoint of productivity.

Further, the toner according to the exemplary embodiment may be prepared by adding an external additive to the obtained toner particles in the dry state and mixing them. For example, the mixing is preferably performed by V-blender, HENSCHEL mixer, LÖEDIGE mixer, or the like. Furthermore, if necessary, it is also preferable to remove the coarse particles of the toner using a vibration sieve machine, a wind classifier, or the like.

Cartridge, Image Forming Method and Image Forming Apparatus

The cartridge according to the exemplary embodiment is a cartridge accommodating at least the two-component developer of the exemplary embodiment. Further, the cartridge of the exemplary embodiment is preferably detachable from the image forming apparatus.

In the case of using the cartridge in a development apparatus, an image forming method or an image forming apparatus, the cartridge may be a developer cartridge for containing the two-component developer of the exemplary embodiment, and also a process cartridge equipped with at least development units for forming a toner image which is developed by developing an electrostatic latent image formed on the image holding member with the two-component developer of the exemplary embodiment.

Further, the process cartridge of the exemplary embodiment may include other members such as an erasing unit depending on other necessary.

The image forming method of the exemplary embodiment includes a charging step of charging at least an image holding member, an exposure step of forming an electrostatic latent image on the surface of the image holding member, a development step of forming a toner image by developing the electrostatic latent image formed on the surface of the image holding member with the electrostatic charge image developer, a transferring step of transferring the toner image formed on the surface of the image holding member to the surface of the transfer medium, and a fixing step of fixing the toner image. The electrostatic charge image developer is preferably a two-component developer of the exemplary embodiment.

In the image forming method of the exemplary embodiment, the two-component developer of the exemplary embodiment is prepared, the formation and development of the electrostatic charge image is conducted using the developer by a commercially available electrophotographic copying machine, the obtained toner image is electrostatically transferred onto the transfer paper and fixed by a heating fixing device to form a copy image.

The respective steps in the image forming method are common processes. In addition, the image forming method of the exemplary embodiment may be carried out using the known image forming apparatus such as copying machines, facsimile machine or the like.

The electrostatic latent image forming step is a step of forming an electrostatic latent image on the image holding member (photoreceptor).

The developing step is a step of forming a toner image by developing the electrostatic latent image with a developer layer on the developer holding member. The developer layer is not particularly limited as long as the layer includes a two-component developer of the exemplary embodiment.

The transferring step is a step of transferring the toner image on the transfer medium. Further, as the transfer medium in the transferring step, the medium to be recorded such as an intermediate transfer member or paper, or the like may be exemplified.

In the fixing step, for example, a method of forming a copy image by fixing the toner image transferred onto the transfer paper using a heating roller fixing device in which the temperature of the heating roller is set to a constant temperature is exemplified.

The image forming method of the exemplary embodiment preferably includes a step (cleaning step) of removing the two-component developer remaining on the image holding member.

As the medium to be recorded, the known medium may be used, for example, the paper used in electrophotographic copying machines, a printer or the like, or an OHP sheet, or the like are exemplified. For example, a coated paper in which the surface of the plain paper is coated with a resin or the like, an art paper for printing, or the like may be suitably used.

The image forming method of the exemplary embodiment may be a method that further includes a recycling step. The recycling step is a step of transferring the toner recovered in the cleaning step to the developer layer. The image forming method of the aspect including this recycling step is carried out using a toner recycling system type copying machine or an image forming apparatus such as facsimile machine or the like. Further, the cleaning step may be omitted, and the recycling step is applied to a recycling system of the aspect in which the toner is recovered simultaneously with the development.

The image forming apparatus of the exemplary embodiment is not particularly limited except that the apparatus includes a two-component developer of the exemplary embodiment as a developer, but the apparatus has an image holding member, a charging unit for charging the image holding member, an exposure units for forming an electrostatic latent image on the image holding member by exposing the charged image holding member, a developing unit for forming a toner image by developing the electrostatic latent image with an electrostatic charge image developer, a transfer unit for transferring the toner image from the image holding member to the transfer medium, and a fixing unit that fixes the toner image. The electrostatic charge image developer is preferably a two-component developer of the exemplary embodiment.

The image forming apparatus of the exemplary embodiment is not particularly limited as long as the apparatus contains at least the image holding member as described above, a charging unit, an exposure unit, a developing unit, and a transfer unit, but, if necessary, the apparatus may include a fixing unit, a cleaning unit, an erasing unit, and the like.

In the transferring unit, the transfer may be performed more than twice using the intermediate transfer member. Further, as the transfer medium in the transferring unit, the medium to be recorded such as an intermediate transfer member, paper, and the like may be exemplified.

The image holding member and the respective units may preferably use configurations described in the respective steps of the image forming method. All of the respective units may use the known units in an image forming apparatus. Further, the image forming apparatus of the exemplary embodiment may include other units or apparatuses other than the configuration described above. Moreover, the image forming apparatus of the exemplary embodiment may perform plural units simultaneously among the units described above.

EXAMPLES

Hereinafter, the exemplary embodiment will be described in detail with examples, but the exemplary embodiment is not limited only to the following examples. The "parts" in the following description indicate the "parts by weight" unless otherwise specified. The "primary particle size" in the following description represents the "volume average particle diameter".

Preparation of Coating Layer Forming Resin Particles 1

120 parts of ion-exchanged water and 0.08 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.12 parts by weight of an anionic surfactant (dodecylbenzene sulfonic acid, BN2060 manufactured by Tayca Corporation), 280 parts by weight of ion-exchanged water, and 0.15 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

This coating layer forming resin particle dispersion 1 is lyophilized at 40° C. for 12 hours to give a coating layer forming resin particles 1. The weight average molecular weight is 1,800,000 at the volume average particle diameter of 310 nm.

Preparation of Coating Layer Forming Resin Particles 2

120 parts of ion-exchanged water and 0.16 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.24 parts by weight of an anionic surfactant (dodecylbenzene sulfonic acid, BN2060 manufactured by Tayca Corporation), 280 parts by weight of ion-exchanged water, and 0.10 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

This coating layer forming resin particle dispersion 2 is lyophilized at 40° C. for 12 hours to give a coating layer forming resin particles 2. The weight average molecular weight is 2,730,000 at the volume average particle diameter of 240 nm.

Preparation of Coating Layer Forming Resin Particles 3

120 parts of ion-exchanged water and 0.20 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.20 parts by weight of an anionic surfactant (dodecylbenzene sulfonic acid, BN2060 manufactured by Tayca Corporation), 280 parts by weight of ion-exchanged water, and 0.08 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

This coating layer forming resin particle dispersion 3 is lyophilized at 40° C. for 12 hours to give a coating layer forming resin particles 3. The weight average molecular weight is 5,010,000 at the volume average particle diameter of 230 nm.

Preparation of Coating Layer Forming Resin Particles 4

120 parts of ion-exchanged water and 0.06 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.14 parts by weight of an anionic surfactant (dodecylbenzene sulfonic acid, BN2060 manufactured by Tayca Corporation), 280 parts by weight of ion-exchanged water, and 0.45 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

As a result, a coating layer forming resin particle dispersion 4 in which the coating layer forming resin particles having the volume average particle diameter of 310 nm are dispersed is obtained. This coating layer forming resin particle dispersion 4 is lyophilized at 40° C. for 12 hours to give coating layer forming resin particles 4. The weight average molecular weight of the coating layer forming resin particles at the volume average particle diameter of 310 nm is measured by using HLC-8220GPC device (manufactured by TOSOH CORPORATION) and using tetrahydrofuran (THF) as an eluent, and using a method for converting the weight average molecular weight according to the molecular weight of the standard styrene, and the weight average molecular weight is 360,000.

Preparation of Coating Layer Forming Resin Particles 5

120 parts of ion-exchanged water and 0.06 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.14 parts by weight of an anionic surfactant (dodecylbenzene sulfonic acid, BN2060 manufactured by Tayca Corporation), 280 parts by weight of ion-exchanged water, and 0.15 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

This coating layer forming resin particle dispersion 5 is lyophilized at 40° C. for 12 hours to give a coating layer forming resin particles 5. The weight average molecular weight is 1,570,000 at the volume average particle diameter of 300 nm.

Preparation of Coating Layer Forming Resin Particles 6

120 parts of ion-exchanged water and 0.24 parts by weight of an anionic surfactant (dodecylbenzene sulfonic acid, BN2060 manufactured by Tayca Corporation) are mixed in the polymerization flask and the mixture is heated in a water bath up to 70° C. 100 parts by weight of cyclohexyl methacrylate monomer, 0.16 parts by weight of an anionic surfactant (dodecylbenzene sulfonic acid, BN2060 manufactured by Tayca Corporation), 280 parts by weight of ion-exchanged water, and 0.05 parts by weight of an initiator (ammonium persulfate) are dissolved in a glass container equipped with another stirring device, and 50 parts by weight of ion-exchanged water is added with stirring to prepare an emulsion. The emulsion is added dropwise to the polymerization flask over 5 hours while maintaining the temperature of the polymerization flask.

This coating layer forming resin particle dispersion 6 is lyophilized at 40° C. for 12 hours to give a coating layer forming resin particles 6. The weight average molecular weight is 6,120,000 at the volume average particle diameter of 230 nm.

Example 1

Preparation of Carrier

Ferrite particles (Mn—Mg ferrite, true specific gravity of 4.7 g/cm$^3$, volume average particle diameter of 40 μm, saturation magnetization of 60 emu/g, and surface roughness of 1.5 μm): 100 parts by weight Coating layer forming resin particles 1: 2.0 parts by weight Charge adjusting resin particles (EPOSUTA S, manufactured by NIPPON SHOKUBAI CO., LTD., melamine resin particles, average particle size of 200 nm): 0.5 parts by weight Carbon black: 0.5 parts by weight First, the raw materials are put into HENSCHEL mixer (manufactured by NIPPON COKE & INDUSTRIES CO., LTD.), and stirred and mixed at 1,200 rpm×20 min to prepare a resin particle adhesion magnetic particles.

The obtained resin adhesion magnetic particles are continuously supplied using a continuous heat treatment apparatus 10 shown in the FIGURE (continuous twin screw extrusion kneader TEM50, manufactured by TOSHIBA MACHINE CO., LTD.) from the raw material inlet 1, the temperature of each of the portions A to D of the casing 3 of the continuous heat treatment apparatus 10 is set to as the temperature described in Table 1, and then the heat-melted products are recovered from the outlet 4. Further, the rotational speed of the screw is set such that the filling rate of the casing reaches from 50 to 100% depending on the feed rate.

The recovered heat-melted products are continuously supplied to comil crushing machine (punching metal, φ of 1 mm) and cooled while being crushed to primary particles. The temperature of the crushed products is set to be 70° C. or lower to give a carrier for two-component developer 1 of Example 1.

Preparation of Externally Added Toner 1

A mixture of 100 parts of styrene-butyl acrylate copolymer (weight average molecular weight Mw=150,000, copolymerization ratio of 80:20 (weight ratio)), 5 parts of carbon black (MOGUL L: manufactured by Cabot Corp.), and 6 parts of carnauba wax is kneaded by an extruder, pulverized by a jet mill, subjected to a spheroidization treatment by hot air at CRYPTRON (Kawasaki Heavy Industries, Ltd.), and classified by a wind classifier to obtain toner particles having particle diameter of 6.2 μm.

100 parts by weight of the toner particles, 1.2 parts by weight of silicone oil-treated silica particles having a volume average particle diameter of 40 nm (RY50: manufactured by Nippon Aerosil Co.), 1.5 parts by weight of hexamethyldisilazane (HMDS) treated silica particles having a volume average particle diameter of 150 nm are mixed in a sample mill to obtain an externally added toner 1.

Preparation of Two-Component Developer 1

External addition toner 1: 8 parts by weight and the carrier 1: 100 parts by weight are stirred at 40 rpm for 20 minutes using a V-blender and sieved using a sieve having a mesh of 125 μm to obtain a two-component developer 1.

Examples 2 and 3, and Comparative Examples 1, 2 and 3

Examples 2 and 3 are prepared under the same conditions as in Example 1 to obtain the carrier for two-component developers 2 and 3, respectively except for changing the coating layer forming resin particles 1 to the coating layer forming resin particles 2 or 3.

Comparative Examples 1, 2 and 3 are prepared under the same conditions as in Example 1 to obtain the carrier for two-component developers 6, 7 and 8, respectively except for changing the coating layer forming resin particles 1 to the coating layer forming resin particles 4, 5 and 6.

Example 4, and Comparative Examples 5 and 6

Example 4, and Comparative Examples 5 and 6 are prepared under the same conditions as in Example 1 to obtain a carrier for two-component developers 4, 10 and 11, respectively except for using the coating layer forming resin particles 2 and changing the temperature of each of the portions A to D of the casing 3 of the continuous heat treatment apparatus 10 (continuous twin screw extrusion kneader TEM50, manufactured by TOSHIBA MACHINE CO., LTD.) shown in the FIGURE to be as the temperature described in Table 1.

Example 5

Preparation of Coating Layer Forming Solution 5

Coating layer forming resin particles 2: 2.0 parts by weight

Toluene: 8.0 parts by weight

Charge adjusting resin particles (EPOSUTA S, manufactured by NIPPON SHOKUBAI CO., LTD., melamine resin particles, average particle size of 200 nm): 0.5 parts by weight Carbon black: 0.5 parts by weight The materials described above stirred and dispersed for 30 minutes in a sand mill to obtain a coating layer forming solution 5.

Preparation of Carrier

Ferrite particles (Mn—Mg ferrite, true specific gravity of 4.7 g/cm$^3$, volume average particle diameter of 40 μm, saturation magnetization of 60 emu/g, surface roughness of 1.5 μm): 100 parts by weight Coating layer forming solution 1: 11 parts by weight The ferrite particles (magnetic particles) and the coating layer forming solution 1 are put in a kneader, heated up to 60° C., stirred for 10 minutes while maintaining the temperature at 60° C., and distilled off the toluene under reduced pressure. Further, the reactants are heated up to 70° C. and distilled off the toluene under reduced pressure. A resin coating layer forming carrier is sieved with a net of an aperture of 75 μm to obtain a carrier for two-component developer 5.

Comparative Example 4

Preparation of Carrier

Ferrite particles (Mn—Mg ferrite, true specific gravity of 4.7 g/cm$^3$, volume average particle diameter of 40 μm, saturation magnetization of 60 emu/g, surface roughness of 1.5 μm): 100 parts by weight Coating layer forming resin particles 2: 2.0 parts by weight Charge adjusting resin particles (EPOSUTA S, manufactured by NIPPON SHOKUBAI CO., LTD., melamine resin particles, average particle size of 200 nm): 0.5 parts by weight Carbon black: 0.5 parts by weight The materials described above are put into HENSCHEL mixer (manufactured by NIPPON COKE & INDUSTRIES CO., LTD.) which has a jacket structure and may be heat treat by the heat medium, and stirred and mixed at 2,000 rpm for 10 minutes to fix the resin particle on the ferrite particles. If the temperature of the HENSCHEL mixer is raised to 200° C. and stirring is carried out at 2,000 rpm, since the carrier forms aggregates in the bath with increasing temperature, the mixer cannot operate at the torque-over of the rotator. Since the mixer may operate up to 110° C. near the glass transition temperature (Tg), the mixer is kept at the temperature for 20 minutes and cooled to 50° C. while rotating at 1,000 rpm to obtain a coating layer forming carrier 8. A resin coating layer forming carrier is sieved with a net of an aperture of 75 μm to obtain a carrier for two-component developer 8.

Preparation of Externally Added Toner and Preparation of Developer

Two-component developers 2 to 11 are prepared and obtained under the same conditions as in Example 1 except for using carrier for two-component developers 2 to 11, respectively instead of the carrier for two-component developer 1.

Evaluation is conducted in the same manner as in Example 1 using the obtained two-component developers. The evaluation results are collectively shown in Table 1.

Evaluation of Carrier and Developer

The printing density evaluation is measured using the developers 1 to 11 by a copying machine DOCU CENTRE COLOR 500 modified machine (manufactured by Fuji Xerox Co., Ltd.), after storage for one week under 15% RH environment at 5° C. which is a lower-temperature and lower-humidity environment, printing the 5% print chart, and carrying out printing the initial (first sheet), 10 sheets, 100 sheets, 1,000 sheets and 10,000 sheets and by using X-RITE939 (manufactured by X-Rite Inc.). The obtained results are shown in Table 1.

The evaluation results are described in the column of evaluation results in Table 1 according to the following criteria.

The presence or absence of deletion (white points) of printed image in the initial sheet.

A: The initial print density is 1.30 or more and there is no change in the print density up to 10,000 sheets.

B: The initial print density is 1.25 or more and the change in the print density may be seen up to 10,000 sheets, but it is problem-free level.

C: The initial print density is 1.25 or less and the variation in the print density is large up to 10,000 sheets.

After the above evaluation is completed, the printing density evaluation is measured by using X-RITE 939 (manufactured by X-Rite Co.) after storage for 24 hours under 85% RH environment at 35° C. which is a higher-temperature and higher-humidity environment, printing the 5% print chart, and carrying out printing 10,000 sheets from the initial (first sheet). The obtained results are shown in Table 1.

The evaluation results are described in the column of evaluation results in Table 1 according to the following criteria.

A: the print density difference between the initial and 10,000 sheets is 0.1 or less and the variation is small.

B: the print density difference between the initial and 10,000 sheets is from 0.1 to 0.15 and the change may be seen, but it is problem-free level.

C: the print density difference between the initial and 10,000 sheets is 0.15 or more and the variation is large.

TABLE 1

| | Carrier for two-component developer No. | Coating layer forming resin particles | | Preparation of carrier | | |
|---|---|---|---|---|---|---|
| | | No. | Mw | Preparation | Heating apparatus | Heating temperature (° C.) Casing A(inlet)/B/C/D(outlet) |
| Example 1 | 1 | 1 | 1,800,000 | Dry coating method | Continuous twin-screw kneader | A to D; 200 |
| Example 2 | 2 | 2 | 2,730,000 | Dry coating method | Continuous twin-screw kneader | A to D; 200 |
| Example 3 | 3 | 3 | 5,010,000 | Dry coating method | Continuous twin-screw kneader | A to D; 200 |
| Example 4 | 4 | 2 | 2,730,000 | Dry coating method | Continuous twin-screw kneader | A; 275/B; 250/C; 225/D; 200 |
| Example 5 | 5 | 2 | 2,730,000 | Solvent dipping method | Kneader | (Under reduce pressure, 60° C.) |
| Comparative Example 1 | 6 | 4 | 360,000 | Dry coating method | Continuous twin-screw kneader | A to D; 200 |
| Comparative Example 2 | 7 | 5 | 1,570,000 | Dry coating method | Continuous twin-screw kneader | A to D: 200 |
| Comparative Example 3 | 8 | 6 | 6,120,000 | Dry coating method | Continuous twin-screw kneader | A to D: 200 |
| Comparative Example 4 | 9 | 2 | 2,730,000 | Dry coating method | Fast stirrer-HENSCHEL mixer | 100 |
| Comparative Example 5 | 10 | 2 | 2,730,000 | Dry coating method | Continuous twin-screw kneader | A to D; 100 |
| Comparative Example 6 | 11 | 2 | 2,730,000 | Dry coating method | Continuous twin-screw kneader | A to D; 275 |

| | Characteristics of Carrier | | Actual machine evaluation results | | |
|---|---|---|---|---|---|
| | Amount of coating resin (% by weight) | Coverage (%) of the surface of the carrier | Initial deletion | 5° C. 15% RH | 35° C. 85% RH |
| Example 1 | 3.0 | 95 | None | A | A |
| Example 2 | 3.0 | 95 | None | A | A |
| Example 3 | 3.0 | 94 | None | A | A |
| Example 4 | 3.0 | 94 | None | A | A |
| Example 5 | 3.0 | 90 | None | B | A |
| Comparative Example 1 | 3.0 | 97 | Presence | A | A |
| Comparative Example 2 | 3.0 | 92 | Presence | B | A |
| Comparative Example 3 | 3.0 | 92 | Presence | B | A |
| Comparative Example 4 | 3.0 | 95 | Presence | B | C |
| Comparative Example 5 | 3.0 | 95 | Presence | B | C |

TABLE 1-continued

| | | | |
|---|---|---|---|
| Comparative Example 6 | 1.5 | 70 | Since the resin is not detected, the evaluation is not conducted. |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for two-component developer comprising:

a magnetic particle; and a resin coating layer that covers the magnetic particle and contains a resin, wherein a weight average molecular weight of the resin is from 1,800,000 to 5,000,000, and wherein the resin coating layer has a thickness of from 0.1 to 10 μm.

2. The carrier for two-component developer according to claim 1, wherein the resin contained in the resin coating layer is selected from the group consisting of polyethylene, polypropylene, polystyrene, polyvinyl ether, polyvinyl ketone, styrene-acrylic acid copolymer, acrylic resin, silicone resin, fluorine resin, polyester, polycarbonate, phenol resin, and epoxy resin.

3. The carrier for two-component developer according to claim 1, wherein the resin contained in the resin coating layer is a homopolymer or a copolymer of cycloalkyl methacrylate.

4. The carrier for two-component developer according to claim 1, wherein a glass transition temperature (Tg) of the resin contained in the resin coating layer is from 50° C. to 150° C.

5. The carrier for two-component developer according to claim 1, wherein the resin coating layer contains resin particles.

6. The carrier for two-component developer according to claim 5, wherein a volume average particle diameter of the resin particles is in a range of 50 nm to 500 nm.

7. The carrier for two-component developer according to claim 5, wherein a weight average molecular weight of the resin particles is from 1,800,000 to 5,000,000.

8. The carrier for two-component developer according to claim 1, wherein the resin coating layer contains resin particles selected from thermosetting resin particles and cross-linked resin particles.

9. A two-component developer comprising:

a toner; and the carrier according to claim 1.

10. A method of preparing a carrier for two-component developer, comprising:

mixing magnetic particles and resin particles having a weight average molecular weight of 1,800,000 to 5,000,000 so that the resin particles attach onto surfaces of the magnetic particles; and heating the magnetic particles to form a resin coating layer, which includes:

charging the magnetic particles, onto which the resin particles are attached, in a continuous heat treatment apparatus from a raw material supply port thereof, wherein the continuous heat treatment apparatus includes a rotator in which a rotating shaft is provided in the same direction as the traveling direction from the raw material supply port toward an outlet in a casing having the raw material supply port and the outlet and is capable of controlling the temperature of each portion of the casing, and heating the magnetic particles onto which the resin particles are attached to melt the resin particles while passing the magnetic particles between the casing and the rotator;

wherein, in heating the magnetic particles, the following expression is satisfied:

Glass transition temperature of resin particles ($Tg$)+50° C.<Temperature of heat-melted product (° C.)≤Thermal decomposition starting temperature of resin particles ($TGA$), and wherein the resin coating layer has a thickness of from 0.1 to 10 μm.

* * * * *